US010466624B2

(12) United States Patent
Kitamura et al.

(10) Patent No.: US 10,466,624 B2
(45) Date of Patent: Nov. 5, 2019

(54) TONER CARTRIDGE AND IMAGE FORMING APPARATUS

(71) Applicant: SHARP KABUSHIKI KAISHA, Sakai, Osaka (JP)

(72) Inventors: Keizoh Kitamura, Sakai (JP); Yasuyuki Ishiguro, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 16/207,123

(22) Filed: Dec. 1, 2018

(65) Prior Publication Data

US 2019/0171132 A1 Jun. 6, 2019

(30) Foreign Application Priority Data

Dec. 4, 2017 (JP) ..... 2017-232866

(51) Int. Cl.
*G03G 15/08* (2006.01)

(52) U.S. Cl.
CPC ..... *G03G 15/0889* (2013.01); *G03G 15/0875* (2013.01); *G03G 15/0886* (2013.01)

(58) Field of Classification Search
CPC ..... G03G 15/0889; G03G 15/0891; G03G 15/0875; G03G 15/0881–0886
See application file for complete search history.

(56) References Cited

U.S. PATENT DOCUMENTS

2012/0033999 A1* 2/2012 Ichikawa ..... G03G 15/0879 399/262
2017/0285527 A1* 10/2017 Okabe ..... G03G 15/0886
2018/0239277 A1* 8/2018 Shirayanagi ..... G03G 15/0868

FOREIGN PATENT DOCUMENTS

JP 2012-037646 A 2/2012

* cited by examiner

*Primary Examiner* — Carla J Therrien
(74) *Attorney, Agent, or Firm* — ScienBiziP, P.C.

(57) ABSTRACT

A toner cartridge includes a screw configured to send stirred toner to an outlet through which the toner is discharged. The toner cartridge includes a partition between the screw and a toner stirrer. The toner stirrer at a default position is in contact with a top of the partition and covers the screw from above to define a closed space around the screw. The closed space is separate from a remaining space having the toner therein. The closed space is in communication with the remaining space when the toner stirrer rotates from the default position to be away from the toner transport screw, enabling the toner to move toward the toner transport screw.

7 Claims, 5 Drawing Sheets

UPWARD RECESS

DOWNWARD RECESS

TONER CARTRIDGE AND IMAGE FORMING APPARATUS

BACKGROUND

1. Field

The present disclosure relates to a toner cartridge containing toner and an image forming apparatus.

2. Description of the Related Art

In general, an image forming apparatus includes a toner cartridge for containing toner.

If a toner cartridge is left unused or stored for a long time with the toner outlet facing down, the toner flowability is deteriorated. Thus, the toner is not discharged when the screw is rotated for the first toner supply after the toner cartridge is attached to the image forming apparatus. The pressure from the screw may lead to solidification of the toner, making the driving portion immovable.

In particular, the recent toner has improved low-temperature fixing properties at the expense of the preservation stability. The recent toner is more likely to aggregate when left untouched.

Japanese Unexamined Patent Application Publication No. 2012-37646 describes a technology for reducing aggregation of toner, which may occur in some storage circumstances, around the toner outlet. The toner cartridge in Japanese Unexamined Patent Application Publication No. 2012-37646 includes a paddle member configured to send toner T in a toner cartridge body toward a screw shaft and a toner blocking member coupled to a portion of the paddle member. In the toner cartridge body before attached to an image forming apparatus, the toner blocking member is positioned at a blocking position where the toner blocking member covers a portion of the screw shaft in the vicinity of the outlet to prevent the toner T from flowing toward the toner outlet. In the toner cartridge body after attached to an image forming apparatus, the toner blocking member is rotated together with the paddle member to be away from the blocking position.

In the technology in Japanese Unexamined Patent Application Publication No. 2012-37646, the toner is in contact with the screw shaft, although a portion of the screw shaft is covered. If a toner cartridge is left unused for a long time, the toner flowability may be deteriorated and the toner aggregation may occur, and thus the toner may not be discharged smoothly through the outlet.

It is desirable to provide a toner cartridge having less toner aggregation at a portion around the outlet at first use of the toner cartridge and to provide an image forming apparatus including the toner cartridge.

SUMMARY

A toner cartridge according to an aspect of the disclosure includes a cartridge body in a box shape, a toner transport screw disposed in the cartridge body, a toner stirrer disposed in the cartridge body and extending substantially parallel to the toner transport screw, and a partition between the toner transport screw and the toner stirrer. The toner stirrer is configured to rotate and stir the toner in the cartridge body. The stirred toner is to be transported by the toner transport screw to an outlet through which the toner is discharged from the cartridge body. The toner stirrer at a default position is in contact with a top of the partition and covers the toner transport screw from above to define a closed space around the toner transport screw. The closed space is separate from a remaining space having the toner. The closed space is in communication with the remaining space when the toner stirrer rotates from the default position to be away from above the toner transport screw, enabling the toner to move toward the toner transport screw.

An image forming apparatus according to another aspect of the disclosure includes the toner cartridge described above.

DESCRIPTION OF THE EMBODIMENTS

Hereinafter, an embodiment of the disclosure is described with reference to the attached drawings.

Figure 1:
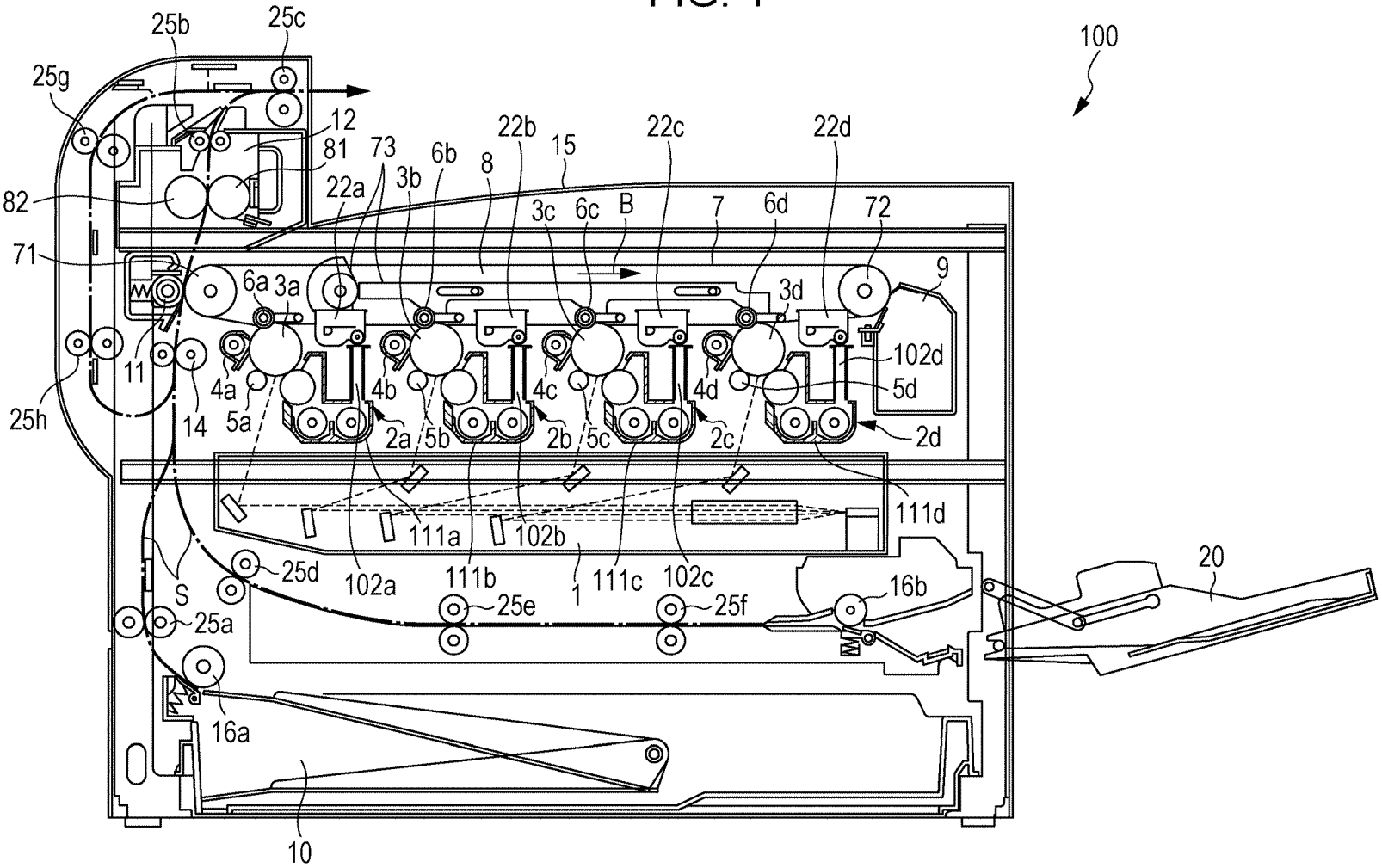
FIG. 1 illustrates an image forming apparatus including a toner cartridge according to an embodiment.
Figure 2A:
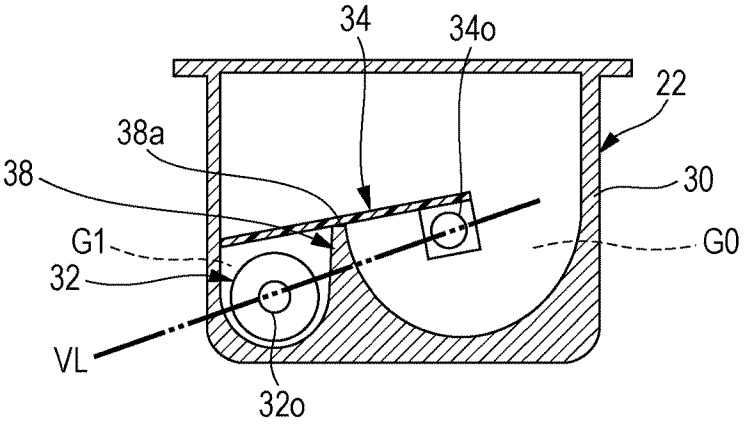
FIG. 2A is a cross-sectional view of the toner cartridge taken perpendicular to the axis of a screw.
Figure 2B:
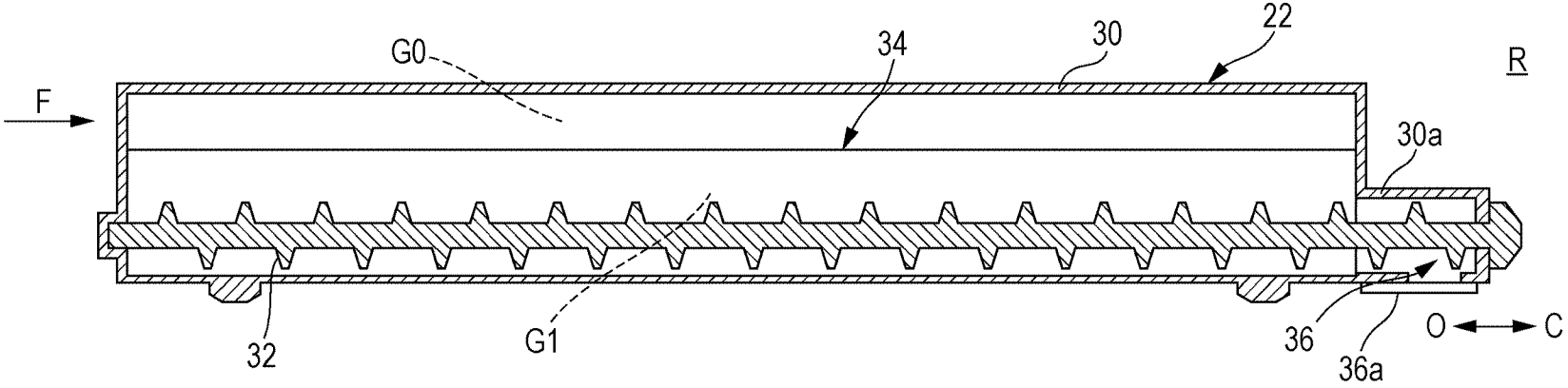
FIG. 2B is a longitudinal sectional view of the toner cartridge taken along the axis of the screw.

FIG. 1 is an overall view of an image forming apparatus. FIGS. 2A and 2B are views of a toner cartridge. FIGS. 3A to 3J are views of toner stirrers of examples.

As illustrated in FIG. 1, an image forming apparatus 100 of the embodiment includes a photosensitive drum 3 on which an electrostatic latent image is formed, a charger (charging device) 5 configured to electrically charge the surface of the photosensitive drum 3, an exposure unit (exposure device) 1 configured to form an electrostatic latent image on the photosensitive drum 3, a developing device (developer containing device) 2 configured to apply toner on the electrostatic latent image on the photosensitive drum 3 to form a toner image, a toner cartridge 22 containing toner and configured to supply the toner to the developing device 2, an intermediate transfer belt unit (transferring device) 8 configured to transfer the toner image on the surface of the photosensitive drum 3 to a recording medium, and a fixing unit (fixer) 12 configured to fix the toner image on the recording medium. The image forming apparatus 100 is an electrophotographic image forming apparatus configured to form images by using toner and has the characteristic configuration described below in the embodiment.

The image forming apparatus 100 forms a multi-color or monochrome image on a predetermined sheet (recording paper, recording medium) in accordance with image data received from an external device. The image forming apparatus 100 may further include a scanner, for example, on the upper side.

The overall configuration of the image forming apparatus 100 is described first.

As illustrated in FIG. 1, the image forming apparatus 100 handles image data of respective color components of black (K), cyan (C), magenta (M), and yellow (Y) to form black, cyan, magenta, and yellow images, and then superimposes these images of different color components to produce a full-color image.

Accordingly, the image forming apparatus 100 includes, as illustrated in FIG. 1, four developing devices 2 (2*a*, 2*b*, 2*c*, and 2*d*), four photosensitive drums 3 (3*a*, 3*b*, 3*c*, and 3*d*), four chargers 5 (5*a*, 5*b*, 5*c*, and 5*d*), and four cleaner units 4 (4*a*, 4*b*, 4*c*, and 4*d*) to form images of four different colors.

In other words, the image forming apparatus 100 includes four image forming stations (image forming portions) each including one developing device 2, one photosensitive drum 3, one charger 5, and one cleaner unit 4.

Here, the symbols "a" to "d" respectively represent the components for forming black images, the components for forming cyan images, the components for forming magenta images, and the components for forming yellow images. The mage forming apparatus 100 further includes the exposure unit 1, the fixing unit 12, a sheet path S, a paper feed tray 10, and a paper output tray 15.

The charger 5 electrically charges the surface of the photosensitive drum 3 uniformly at a predetermined potential.

The charger 5 may be a contact brush charger or a non-contact charger, for example, other than the contact roller charger illustrated in FIG. 1.

As illustrated in FIG. 1, the exposure unit 1 is a laser scanning unit (LSU) including a laser emitter and a reflection mirror. Other than the laser scanning unit, arrays of light emitting elements such as EL (electroluminescence) or LED writing heads, may also be used as the exposure unit 1. The exposure unit 1 applies laser beams to the photosensitive drums 3 that have been electrically charged, in accordance with input image data, so as to form electrostatic latent images corresponding to the image data on the surfaces of photosensitive drums 3.

The developing device 2 visualizes (develops) the electrostatic latent image formed on the photosensitive drum 3 with toner of K, C, M or Y. The developing devices 2 (2*a*, 2*b*, 2*c*, and 2*d*) include toner transport mechanisms 102 (102*a*, 102*b*, 102*c*, and 102*d*), toner cartridges 22 (22*a*, 22*b*, 22*c*, and 22*d*), and developing vessels (developer containers) 111 (111*a*, 111*b*, 111*c*, and 111*d*).

The toner cartridge 22 is disposed above the developing vessel 111 and contains unused toner (powder toner). As described below, the toner cartridges 22 (22*a*, 22*b*, 22*c*, and 22*d*) each include a toner stirrer 34 (refer to FIGS. 2A and 2B) and a toner transport screw 32 in a toner cartridge body 30. The toner is supplied from the toner cartridge 22 to the developing vessel 111 via the toner transport mechanism 102.

The cleaner unit 4 removes and collects the toner remaining on the surface of the photosensitive drum 3 after developing and image transferring steps.

The intermediate transfer belt unit 8 is disposed above the photosensitive drums 3. The intermediate transfer belt unit 8 includes intermediate transfer rollers 6 (6*a*, 6*b*, 6*c*, and 6*d*), an intermediate transfer belt 7, an intermediate transfer belt drive roller 71, an intermediate transfer belt driven roller 72, an intermediate transfer belt tensioning mechanism 73, and an intermediate transfer belt cleaning unit 9.

The intermediate transfer rollers 6, the intermediate transfer belt drive roller 71, the intermediate transfer belt driven roller 72, and the intermediate transfer belt tensioning mechanism 73 support the intermediate transfer belt 7 in a tensioned state and rotate the intermediate transfer belt 7 in the direction indicated by an arrow B in FIG. 1.

The intermediate transfer rollers 6 are rotatably supported by intermediate transfer roller fitting portions of the intermediate transfer belt tensioning mechanism 73 included in the intermediate transfer belt unit 8. A transfer bias for transferring the toner image from the photosensitive drum 3 to the intermediate transfer belt 7 is applied to each of the intermediate transfer rollers 6.

The intermediate transfer belt 7 is in contact with the photosensitive drums 3. The toner images of different color components on the photosensitive drums 3 are successively transferred one on top of another onto the intermediate transfer belt 7 to form a full-color toner image (multi-color toner image). The intermediate transfer belt 7 is an endless belt formed of a film having a thickness of about 100 μm to about 150 μm, for example.

The toner images are transferred from the photosensitive drums 3 to the intermediate transfer belt 7 by the intermediate transfer rollers 6 in contact with the interior surface of intermediate transfer belt 7. A high-voltage transfer bias (a high voltage of a polarity (+) opposite to the polarity (−) of the charge on the toner) is applied to the intermediate transfer rollers 6 to transfer the toner images.

The intermediate transfer roller 6 is composed of a metal shaft (stainless steel shaft, for example) having a diameter of about 8 mm to about 10 mm as a base coated with a conductive elastic material (EPDM, foamed urethane, for example). The conductive elastic material enables the intermediate transfer roller 6 to uniformly apply the high voltage to the intermediate transfer belt 7. Although this embodiment employs roller-shaped elements (intermediate transfer rollers 6) as the transfer electrodes, brushes may be used instead of the roller-shaped elements.

The electrostatic latent image formed on each of the photosensitive drums 3 is developed with the toner for its color component into a visual toner image as described above. These toner images are layered on top of another on the intermediate transfer belt 7. The resultant toner image is moved by rotation of the intermediate transfer belt 7 to the contact position (transfer position) where the conveyed paper and the intermediate transfer belt 7 are in contact with each other and is transferred to the paper by the transfer roller 11 at this position. In this case, the intermediate transfer belt 7 and the transfer roller 11 are pressed against each other with a predetermined nip pressure while a voltage for transferring the toner image to the paper is applied to the transfer roller 11. This voltage is a high voltage of a polarity (+) opposite to the polarity (−) of the charge on the toner.

In order to steadily keep the aforementioned nip pressure, one of the transfer roller 11 and the intermediate transfer belt drive roller 71 is formed of a hard material, such as metal, while the other is formed of a soft material, such as an elastic roller (elastic rubber roller or foamed resin roller, for example).

Some of the toner may adhere to the intermediate transfer belt 7 as a result of contact between the intermediate transfer belt 7 and the photosensitive drums 3. Some of the toner may not be transferred from the intermediate transfer belt 7 to the paper during transfer of the toner image to the paper and remain on the intermediate transfer belt 7. The adhering toner and the remaining toner may cause toner color mixture at the next step, and thus the intermediate transfer belt cleaning unit 9 removes and collects such toner.

The intermediate transfer belt cleaning unit 9 includes a cleaning blade (cleaning member) that comes into contact with the intermediate transfer belt 7. The intermediate transfer belt 7 is supported from an inner side by the intermediate transfer belt driven roller 72 at a portion in contact with the cleaning blade.

The paper feed tray 10 is configured to store sheets (recording paper, for example) usable for image forming and is disposed below the image forming portion and the exposure unit 1. The paper output tray 15 is disposed at the upper side of the image forming apparatus 100 and the paper output tray 15 receives the printed sheet, the print surface of which faces down.

The image forming apparatus 100 further includes the sheet path S for guiding sheets from the paper feed tray 10 and from a manual feed tray 20 to the paper output tray 15 via the transfer portion and the fixing unit 12. The transfer portion is located between the intermediate transfer belt drive roller 71 and the transfer roller 11.

In the sheet path S, pickup rollers 16 (16*a* and 16*b*), a registration roller 14, the transfer portion, the fixing unit 12, and feed rollers 25 (25*a* to 25*h*), for example, are provided.

The feed rollers 25 are small rollers arranged along the sheet path S to promote and assist sheet conveyance. The pickup roller 16*a* is disposed at the end of the paper feed tray 10 to pick up and supply the paper, one sheet at a time, from the paper feed tray 10 to the sheet path S. The pickup roller 16*b* is disposed near the manual feed tray 20 to pick up and supply the paper, one sheet at a time, from the manual feed tray 20 to the sheet path S. The registration roller 14 temporarily keeps the sheet being conveyed on the sheet path S and delivers the sheet to the transfer portion at such timing that the front end of the sheet meets the front end of the toner image on the intermediate transfer belt 7.

The fixing unit 12 includes a heat roller 81 and a pressing roller 82, for example. The heat roller 81 and the pressing roller 82 rotate with the sheet therebetween. The heat roller 81 is controlled by a controller (not illustrated) so as to keep a predetermined fixing temperature. The controller controls the temperature of the heat roller 81 based on the detection signal from a temperature detector (not illustrated).

The heat roller 81 thermally presses the sheet together with the pressing roller 82 to fuse, mix, and press the layered color toner images on the sheet, and thus the toner is thermally fixed onto the sheet. The sheet with a multi-color toner image (single color toner images) fixed thereon is conveyed by the feed rollers 25 to an inversion paper discharge path of the sheet path S and the sheet in an inverted position (with the multi-color toner image facing down) is discharged onto the paper output tray 15.

Next, the sheet conveyance by the sheet path S is described.

As illustrated in FIG. 1, the image forming apparatus 100 is equipped with the above-described paper feed tray 10 that stores sheets beforehand and the manual feed tray 20 that is used for printing of a few pages. Each tray is provided with the pickup roller 16 (16*a*, 16*b*) such that the pickup rollers 16 supply one sheet at a time to the sheet path S.

For one-sided printing, the sheet fed from the paper feed tray 10 is conveyed by the feed roller 25*a* on the sheet path S to the registration roller 14 and conveyed by the registration roller 14 to the transfer portion (the contact position where the transfer roller 11 and the intermediate transfer belt 7 are in contact with each other) at such timing that the front end of the sheet meets the front end of the layered toner images on the intermediate transfer belt 7. At the transfer portion, the toner images are transferred onto the sheet. The toner images are fixed onto the sheet by the fixing unit 12. Then, the sheet passes through the feed roller 25*b* and is discharged by a paper output roller 25*c* onto the paper output tray 15.

The sheet fed from the manual feed tray 20 is conveyed by the feed rollers 25 (25*f*, 25*e*, and 25*d*) to the registration roller 14. Then, the sheet is discharged to the paper output tray 15 through the same path as that of the sheet fed from the paper feed tray 10.

For dual-sided printing, the sheet which has been printed on the first side and passed through the fixing unit 12 as described above is nipped at its rear end by the paper discharge roller 25*c*. Then, the paper discharge roller 25*c* is rotated in the reverse direction such that the sheet is guided to the feed rollers 25*g* and 25*h* and conveyed again through the registration roller 14 such that the sheet is printed on its rear side. Then, the sheet is discharged onto the paper output tray 15.

Next, the toner cartridge 22 of the embodiment is described in detail with reference to the drawings. FIGS. 2A and 2B are explanatory views of the toner cartridge 22.

As illustrated in FIGS. 2A and 2B, the toner cartridge 22 includes a toner transport screw 32 and a toner stirrer 34 in a box-like toner cartridge body 30. The toner stirrer 34 extends substantially parallel to the screw 32 and configured to rotate to stir the toner. The toner cartridge 22 is attached to the image forming apparatus in the insertion direction indicated by the arrow in FIG. 2B such that the side F is positioned at the front side and the side R is positioned at the rear side of the image forming apparatus.

After the attachment, a shutter 36*a* is opened to open the outlet 36, allowing the toner stirred for the first time by the toner stirrer 34 to be transported by the screw 32 so as to be discharged through the outlet 36. As illustrated in FIG. 2B, the shutter 36*a* is movable in the directions indicated by the arrows O and C for open/close operations.

The toner cartridge body 30 is a box having walls defining an interior space. The screw 32 and the toner stirrer 34 are in the space. The toner cartridge body 30 has a box-like shape elongated in the axial direction of the screw 32 and the toner stirrer 34.

The toner cartridge body 30 includes an extended portion 30*a* corresponding to an axial end portion of the screw 32. The lower surface of the extended portion 30*a* has the outlet 36, which is opened/closed by the shutter 36*a*.

A partition 38 is provided between the screw 32 and the toner stirrer 34. In the toner cartridge 22 after shipment and before use, the toner stirrer 34 at the default position is in contact with the top 38*a* of the partition 38 and covers the screw 32 from above. This allows the space (indicated by "G1") around the screw 32 to be a closed space separate from the remaining space of the toner cartridge body 30 having the toner therein. The space of the toner cartridge body 30 other than the space G1 is indicated by "G0". In the toner cartridge before use having the toner stirrer 34 at the default position, the space G1 around the screw 32 has no toner therein, and the space G0 has the toner therein around the toner stirrer 34. The toner does not exist in the space G1 around the screw 32, and thus the toner does not exist around the outlet 36 when the toner stirrer 34 is located at the default position. In this configuration, the toner is unlikely to flow toward the outlet 36.

The toner stirrer 34 moves from the position above the screw 32, when rotated from the default position, such that the space G1 around the screw 32 is in communication with the space G0 of the toner cartridge body having the toner therein. This enables the toner to move toward the screw 32. Then, the toner is sent to the outlet 36 by rotation of the screw 32.

The toner stirrer 34 at the default position covers the screw 32 from above while being in contact with the top 38*a* of the partition 38. In such a state, the top 38*a* of the partition 38 is positioned above an imaginary straight line (indicated by "VL" in FIG. 2) connecting a rotation center 320 of the screw 32 with a rotation center 340 of the toner stirrer 34.

The default position of the toner stirrer 34 is where the toner stirrer 34 is in contact with the partition 38 and covers the screw 32 from above. When the toner stirrer 34 is rotated from the default position, the screw 32 is able to send the toner to the outlet 36.

The toner stirrer 34 may be formed of a plastic sheet (formed of resin, for example).

Examples 1 to 10 of the toner stirrer 34 are described with reference to FIGS. 3A to 3J.

Figure 3A:
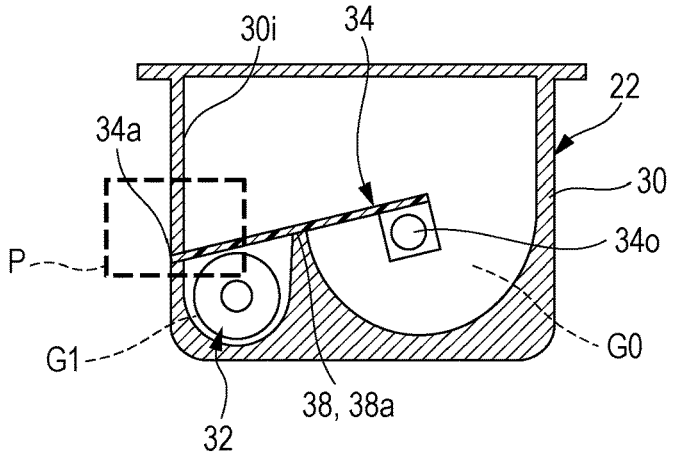
FIGS. 3A to 3J illustrate examples of a toner stirrer included in the toner cartridge.
Figure 3B:
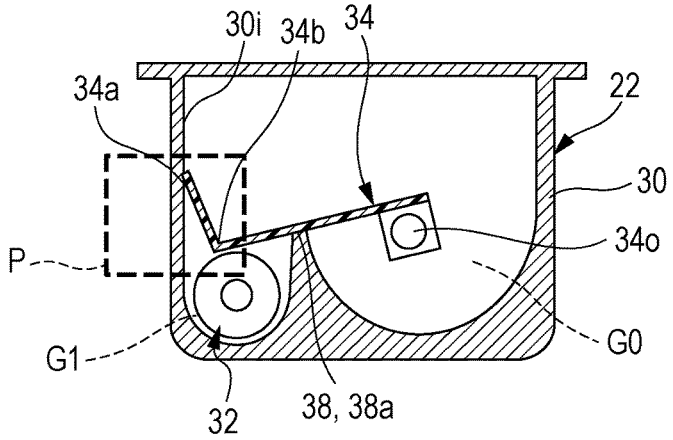

In Example 1 illustrated in FIG. 3A, the screw 32 is located between an inner surface 30*i* of the toner cartridge body 30 of the toner cartridge 22 and the partition 38. The toner stirrer 34 (end 34*a*) is in contact with the inner surface 30*i* (indicated by a broken line "P") when located at the default position and covers the screw 32 from above while being in contact with the top 38*a* of the partition 38.

The toner stirrer 34 in this state allows the space G1 around the screw 32 to be a closed space, which is separate from the space G0 of the toner cartridge body having the toner therein, with a simple structure. The toner stirrer 34 is flat and no special fixing member is requested, and thus the structure is simple.

In Example 2 illustrated in FIG. 38, the toner stirrer 34 has a bent portion 34*b* bent at a position close to the portion in contact with the inner surface 30*i* of the toner cartridge body 30 and the toner stirrer 34 (end 34*a*) is in contact with the surface 30*i* (area indicated by "P".) when located at the default position and covers the screw 32 from above while being in contact with the top 38*a* of the partition 38.

The toner stirrer 34 in this state has the end 34*a* of the bent portion 34*b* firmly caught on the inner surface, and thus this configuration allows the space G1 around the screw 32 to be a closed space separate from the remaining space G0 of the toner cartridge body having the toner therein.

Figure 3C:
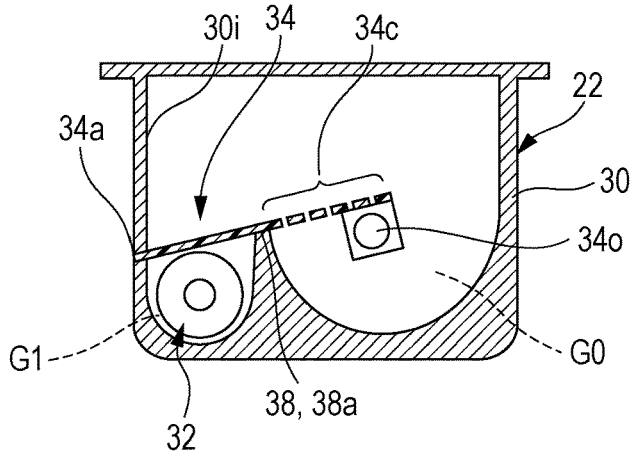

In Example 3 illustrated in FIG. 3C, the toner stirrer 34 has holes and/or slits 34*c* for torque reduction, for example, outside an area over the screw 32. In Example 3, the toner stirrer 34 has the holes and/or slits 34*c* in the area adjacent to the rotation center 34*o*. The toner passes through the holes and/or slits 34*c* during the rotation of the toner stirrer 34, enabling efficient stirring of the toner.

Figure 3D:
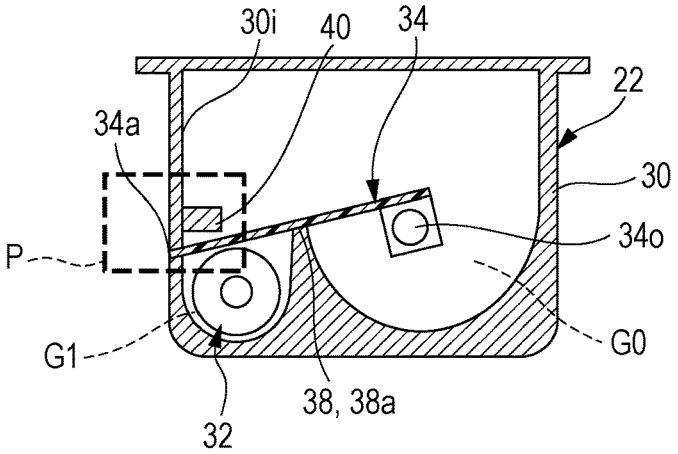

In Example 4 illustrated in FIG. 3D, a protrusion 40 is provided on the inner surface 30*i*. The toner stirrer 34 (end 34*a*) is in contact with the inner surface 30*i* and is retained below the protrusion 40 (in an area indicated by "P") when the toner stirrer 34 is located at the default position and covers the screw 32 from above while being in contact with the top 38*a* of the partition 38. The toner stirrer 34 is unlikely to be separate when the toner cartridge 22 is shaken during transportation, for example, because the toner stirrer 34 at the default position has the end 34*a* retained by the protrusion 40.

Figure 3E:
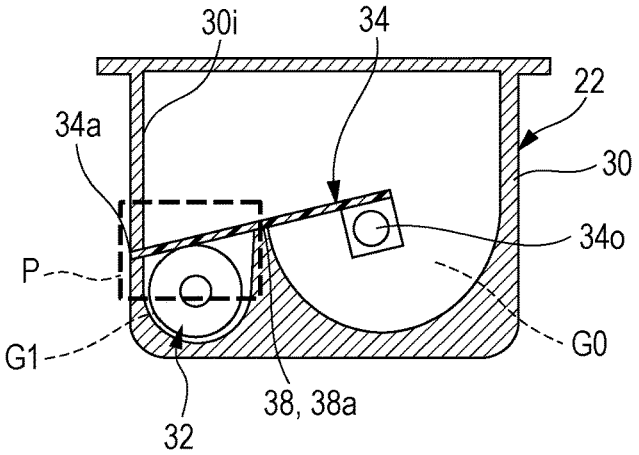

In Example 5 illustrated in FIG. 3E, a portion of the toner stirrer 34 adjacent to the end 34*a* is in contact with the toner transport screw 32 (area indicated by "P") when the toner stirrer 34 is located at the default position and covers the screw 32 from above while being in contact with the top 38*a* of the partition 38. In this configuration, the space G1 around the screw 32 is made smaller because the portion of the toner stirrer 34 adjacent to the end 34*a* is in contact with the screw 32.

Figure 3F:
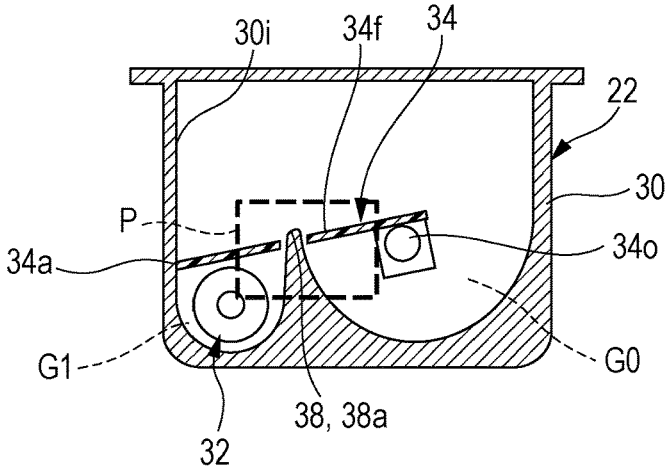

In Example 6 illustrated in FIG. 3F, the toner stirrer 34 has a slit or hole 34*f* in which the top 38*a* of the partition 38 is positioned. The toner stirrer 34 is retained by the top 38*a* in the slit or hole 34*f* (area indicated by "P") when located at the default position and covers the screw 32 from above while being in contact with the top 38*a* of the partition 38.

In this configuration, the tonner stirrer 34 is unlikely to be detached when the toner cartridge 22 is shaken during transportation, for example, because the toner stirrer 34 at the default position is retained by the top 38*a*.

Figure 3G:
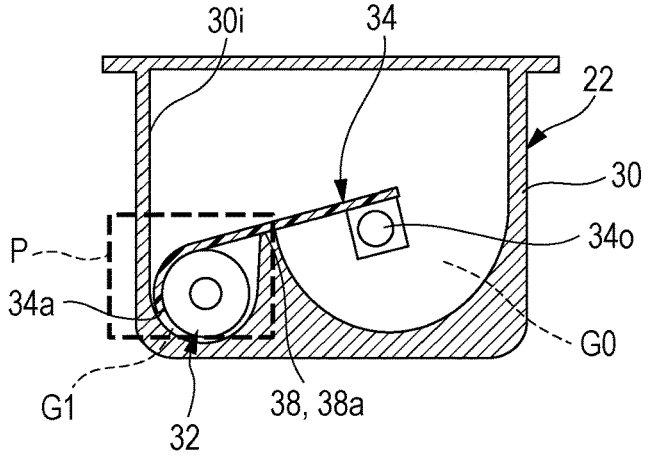

In Example 7 illustrated in FIG. 3G, the end 34*a* of the toner stirrer 34 is wound around the screw 32 (area indicated by "P") when the toner stirrer 34 is located at the default position and covers the screw 32 from above while being in contact with the top 38*a* of the partition 38. In this configuration, the toner stirrer 34 is unlikely to be detached when the toner cartridge 22 is shaken during transportation, for example, because the toner stirrer 34 at the default position is retained by the end 34*a* wound around the screw 32.

Figure 3H:
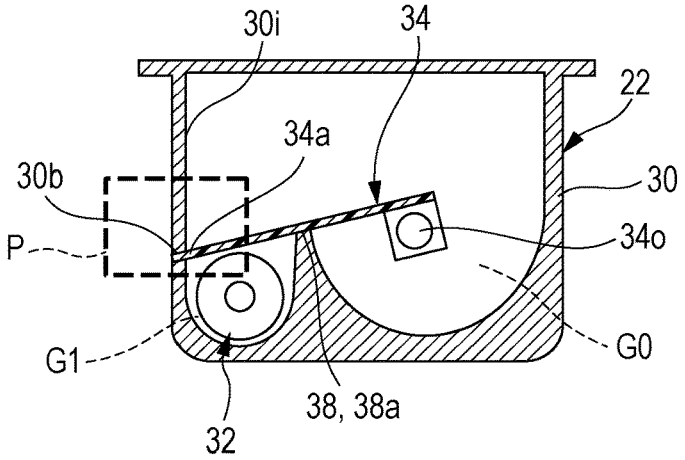

In Example 8 illustrated in FIG. 3H, the inner surface 30*i* of the toner cartridge body 30 has a recess 30*b* for catching the end 34*a* of the toner stirrer 34. The recess 30*b* is formed at a position where the recess 30*b* receives the end 34*a* of the toner stirrer 34 when the toner stirrer 34 is located at the default position and covers the screw 32 from above while being in contact with the top 38*a* of the partition 38. The toner stirrer 34 is unlikely to be detached when the toner cartridge 22 is shaken during transportation, for example, because the end 34*a* positioned in the recess 30*b* as above is unlikely to be detached from the recess 30*b* when the toner stirrer 34 is at the default position.

Figure 3I:
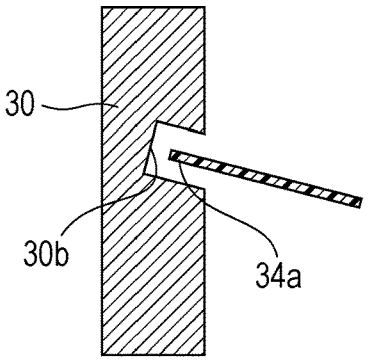
Figure 3J:
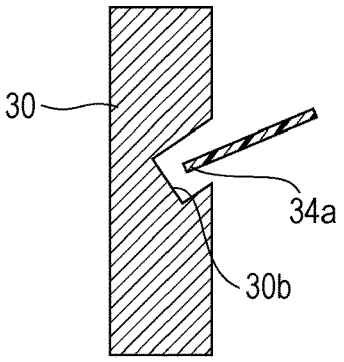

The recess 30*b* may extend in any direction. For example, the recess 30*b* may extend upwardly as illustrated in FIG. 3T. Alternatively, the recess 30*b* may extend downwardly as illustrated in FIG. 3J. The end 34*a* of the toner stirrer 34 is bent upwardly to fit in the recess 30*b* extending upwardly as illustrated in FIG. 3I. The bent recess 34*a* more reliably catches the toner stirrer 34 than a horizontal recess. The end 34*a* of the toner stirrer 34 is not bent to fit in the recess 30*b* extending downwardly as illustrated in FIG. 30. This allows the toner stirrer 34 to be readily attached/detached.

In the configuration of the toner cartridge 22 of the embodiment, the toner is discharged through the outlet 36 in the extended portion 30*a*, which is located at one end of the toner cartridge body 30, when the toner transport screw 32 is rotated.

The rotatable toner stirrer 34 located near the screw 32 covers the screw 32 from above to prevent the toner from flowing toward the toner outlet 36. When the toner stirrer 34 is rotated, the screw 32 is uncovered to allow the toner to be discharged through the outlet 36.

If the toner cartridge 22 of the embodiment is left untouched for a long time, the toner flowability may be deteriorated. However, in this embodiment, the toner does not exist around the screw 32 when the toner cartridge 22 is used for the first time, because the toner stirrer 34 covers the screw 32. The toner becomes flowable again when stirred by the toner stirrer 34 and the toner in such a state is transported by the screw 32.

In this configuration, when the toner cartridge is left untouched for a long time with the toner outlet facing down and the toner flowability is deteriorated as the toner cartridge in the related art, the screw is able to rotate for the first toner supply, because no toner exists around the screw, and the tonner stirred by the toner stirrer is smoothly discharged. Furthermore, the toner is not subjected to pressure of the screw, and thus the toner is not solidified, not making the driving portion immovable. The recent toner having the improved low-temperature fixing properties, which is likely to aggregate when left untouched, is unlikely to aggregate, because the space is provided around the screw 32 when the toner stirrer 34 is at the default position. The toner is discharged when the screw 32 is rotated for the first toner supply after the toner cartridge is attached to the image forming apparatus.

In this embodiment, the toner cartridge illustrated in FIGS. 2A to 3J is used in the image forming apparatus illustrated in FIG. 1. However, the toner cartridge may be modified from the configuration illustrated in FIGS. 3A to 3J without departing from the scope of the present technology and may be used in devices other than the image forming apparatus illustrated in FIG. 1.

The toner cartridge of this technology may be used as a replaceable toner cartridge attached to an electrophotographic image forming apparatus such as a copier multifunction printer.

The present disclosure contains subject matter related to that disclosed in Japanese Priority Patent Application JP 2017-232866 filed in the Japan Patent Office on Dec. 4, 2017, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A toner cartridge comprising:

a cartridge body in a box shape;

a toner transport screw disposed in the cartridge body;

a toner stirrer disposed in the cartridge body and extending substantially an entire width of the cartridge body and parallel to the toner transport screw, the toner stirrer being configured to rotate and stir toner in the cartridge body, the stirred toner to be transported by the toner transport screw to an outlet through which the toner is discharged from the cartridge body; and a partition between the toner transport screw and the toner stirrer, wherein the toner stirrer at a default position is in contact with a top of the partition and covers the toner transport screw from above to define a closed space around the toner transport screw, the closed space being separate from a remaining space having the toner, and the closed space is in communication with the remaining space when the toner stirrer rotates from the default position to be away from above the toner transport screw, enabling the toner to move toward the toner transport screw.

2. The toner cartridge according to claim 1, wherein the top of the partition is positioned above an imaginary straight line connecting a rotation center of the toner transport screw with a rotation center of the toner stirrer when the toner stirrer at the default position is in contact with the top of the partition and covers the toner transport screw from above.

3. The toner cartridge according to claim 1, wherein the toner stirrer is formed of a plastic sheet.

4. The toner cartridge according to claim 1, wherein the toner transport screw is positioned between an inner surface of the cartridge body and the partition, and the toner stirrer is in contact with the inner surface when the toner stirrer at the default position is in contact with the top of the partition and covers the toner transport screw from above.

5. The toner cartridge according to claim 1, wherein the toner stirrer has a bent portion bent at a position close to an inner surface of the cartridge body and the toner stirrer is in contact with the inner surface of the cartridge body at the bent portion when the toner stirrer at the default position is in contact with the top of the partition and covers the toner transport screw from above.

6. The toner cartridge according to claim 1, wherein the toner stirrer has a hole, a slit, or both the hole and the slit outside an area over the toner transport screw.

7. An image forming apparatus comprising the toner cartridge according to claim 1.

* * * * *